US006152428A

United States Patent [19]

Simioni

[11] Patent Number: 6,152,428

[45] Date of Patent: Nov. 28, 2000

[54] FENCE SYSTEM

[76] Inventor: Lino Simioni, 3680 Barnsdale Road, Nepean, Ontario, Canada, K2C 3H2

[21] Appl. No.: 09/200,784

[22] Filed: Nov. 30, 1998

[30] Foreign Application Priority Data

Dec. 18, 1997 [CA] Canada ..... 2225216

[51] Int. Cl.[7] ..... E04H 17/24

[52] U.S. Cl. ..... 256/24; 256/19

[58] Field of Search ..... 256/19, 21, 22, 256/24, 25, 31, 59, 65, 66; 52/520, 359, 650.3, 653.1, 690

[56] References Cited

U.S. PATENT DOCUMENTS

| | | | |
|---|---|---|---|
| 143,372 | 9/1873 | Nichols . | |
| 709,300 | 9/1902 | Buchtel . | |
| 756,618 | 4/1904 | Friestedt . | |
| 766,185 | 8/1904 | Harold . | |
| 803,741 | 11/1905 | Carlson . | |
| 877,076 | 1/1908 | Hageman . | |
| 1,138,105 | 5/1915 | Hegstedt . | |
| 1,160,728 | 11/1915 | Liggett . | |
| 1,709,778 | 4/1929 | Crozier . | |
| 2,573,239 | 10/1951 | Barrett . | |
| 2,809,017 | 6/1957 | Wong . | |
| 2,919,113 | 12/1959 | Cofield . | |
| 2,971,617 | 2/1961 | Smith et al. . | |
| 3,385,567 | 5/1968 | Case et al. | 256/24 |
| 3,454,262 | 7/1969 | Romano . | |
| 3,799,506 | 3/1974 | Schwartz | 256/24 |
| 3,883,120 | 5/1975 | Tippmann | 256/24 |
| 3,924,834 | 12/1975 | Young | 256/22 |
| 4,050,828 | 9/1977 | Noro | 403/201 X |
| 4,202,532 | 5/1980 | Mills | 256/24 |
| 4,306,631 | 12/1981 | Reusser | 181/210 X |
| 4,324,388 | 4/1982 | Klaser | 256/19 |
| 4,369,953 | 1/1983 | Greiner et al. | 256/24 |
| 4,722,514 | 2/1988 | Pettit | 256/50 X |
| 4,782,638 | 11/1988 | Hovind | 52/547 X |
| 4,809,955 | 3/1989 | Veilleux | 256/65 |
| 4,918,899 | 4/1990 | Karytinos | 52/690 |
| 5,100,107 | 3/1992 | Latta | 256/19 |
| 5,149,061 | 9/1992 | Borgnini | 256/24 |
| 5,286,137 | 2/1994 | Cicinnati et al. | 404/6 X |
| 5,494,261 | 2/1996 | Gandara | 256/24 |
| 5,529,289 | 6/1996 | Lancer, Sr. | 256/66 |
| 5,533,715 | 7/1996 | Dandrea | 256/45 X |
| 5,575,127 | 11/1996 | O'Neal | 52/520 |
| 5,649,688 | 7/1997 | Baker | 256/21 |
| 5,651,227 | 7/1997 | Anderson | 52/520 |
| 5,657,606 | 8/1997 | Ressel et al. | 52/690 |
| 5,695,174 | 12/1997 | Tsai | 256/22 |
| 5,702,090 | 12/1997 | Edgman | 256/19 |

FOREIGN PATENT DOCUMENTS

| | | | |
|---|---|---|---|
| 2646195 | 10/1990 | France | 256/24 |
| 2200425 | 7/1972 | Germany | 256/24 |
| 620135 | 3/1949 | United Kingdom . | |
| 8802428 | 4/1988 | WIPO | 256/65 |

*Primary Examiner*—Harry C. Kim

[57] ABSTRACT

A relatively simple, inexpensive fence can be constructed using mostly off-the-shelf building supplies. The fence includes a plurality of posts defined by wooden posts encased in sections of vinyl eaves trough, a frame constructed of galvanized track and stud elements normally used in the roughing in of interior office walls, J-strips on each end of the frame abutting the posts, and vertical panels formed of vinyl siding connected to each other and to the frame between the posts.

5 Claims, 5 Drawing Sheets

FENCE SYSTEM

BACKGROUND OF THE INVENTION

1. Field of the Invention

This invention relates to a fence system, and in particular to a modular fence system.

2. Discussion of the Prior Art

There is a large volume of literature relating to metal and/or plastic fence systems of the type including a plurality of spaced apart posts interconnected by top and bottom rails, and panels attached to the rails. Examples of such systems are found in Canadian Patent Applications Nos. 2,047,645, which was filed in the name of A. B. Parker on Jul. 24, 1991, and 2,166,587, which was filed in the name of L. Parth on Jan. 4, 1996, and U.S. Pat. No. 3,136,530, which issued to J. S. Case on Jun. 9, 1964; U.S. Pat. No. 3,454,262, which issued to N. P. Romano on Jul. 8, 1969; U.S. Pat. No. 4,063,714, which issued to R. E. Kirkwood on Dec. 20, 1977; U.S. Pat. No. 4,188,019, which issued to H. F. Meredith on Feb. 12, 1980; U.S. Pat. No. 4,231,552, which issued to C. F. Thomas on Nov. 4, 1980; U.S. Pat. No. 4,369,953, which issued to W. H. Greiner et al on Jan. 25, 1983; U.S. Pat. No. 5,441,240, which issued to J. L. Arnold on Aug. 15, 1995; U.S. Pat. No. 5,474,279, which issued to H. E. Parisien on Dec. 12, 1995; U.S. Pat. No. 5,492,307, which issued to S. L. Begue Jr. et al on Feb. 20, 1996; U.S. Pat. No. 5,494,261, which issued to E. P. Gandara on Feb. 27, 1996; U.S. Pat. No. 5,628,495, which issued to E. P. Gandara on May 13, 1997 and U.S. Pat. No. 5,657,967, which issued to T. D. Patrick on Aug. 19, 1997.

In general, the fence systems described in the above listed patent literature tend to be somewhat complicated, relying on custom-made brackets or other elements which are expensive to produce because of their limited application. Thus, in spite of the large number of such products described in the literature, a need still exists for a fence system which can be produced using off-the-shelf hardware, i.e. readily available elements which are not tailor made for the system.

GENERAL DESCRIPTION OF THE INVENTION

An object of the present invention is to meet the above-mentioned need by providing a relatively simple fence system, which includes already existing elements, which were designed for other purposes.

Another object of the invention is to provide a fence system which is durable, easy to assemble, and virtually maintenance fee.

Accordingly, the invention relates to a fence system comprising:

at least two posts, a frame for mounting on said posts, said frame including a pair of C-cross section tracks for mounting on said posts in opposition to each other, and a plurality of C-cross section rails for extending between at least the top and bottom ends of said tracks; and a plurality of panels for mounting on said rails, said panels including strips of vinyl siding, each having a longitudinally extending hook on one side thereof for mating with a longitudinally extending groove proximate the other side of the strip, and a row of perforations in said other side edge for receiving screws to fasten the strip to said rails.

BRIEF DESCRIPTION OF THE DRAWINGS

The invention is described hereinafter in greater detail with reference to the accompanying drawings, which illustrate a preferred embodiment of the invention, and wherein.

DESCRIPTION OF THE PREFERRED EMBODIMENT

Figure 1:
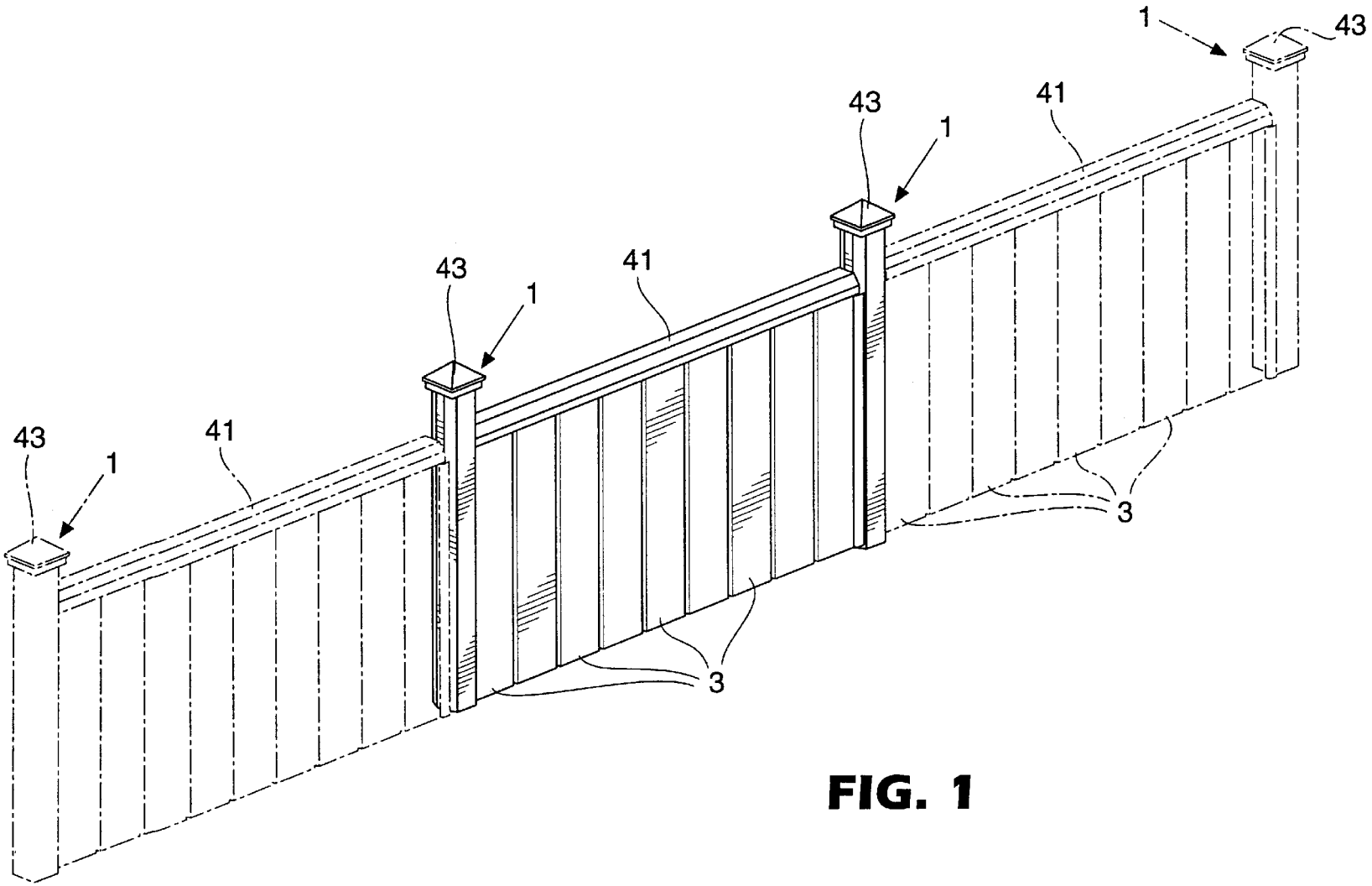
FIG. 1 is an isometric view of a section of fence system in accordance with the present invention.
Figure 2:
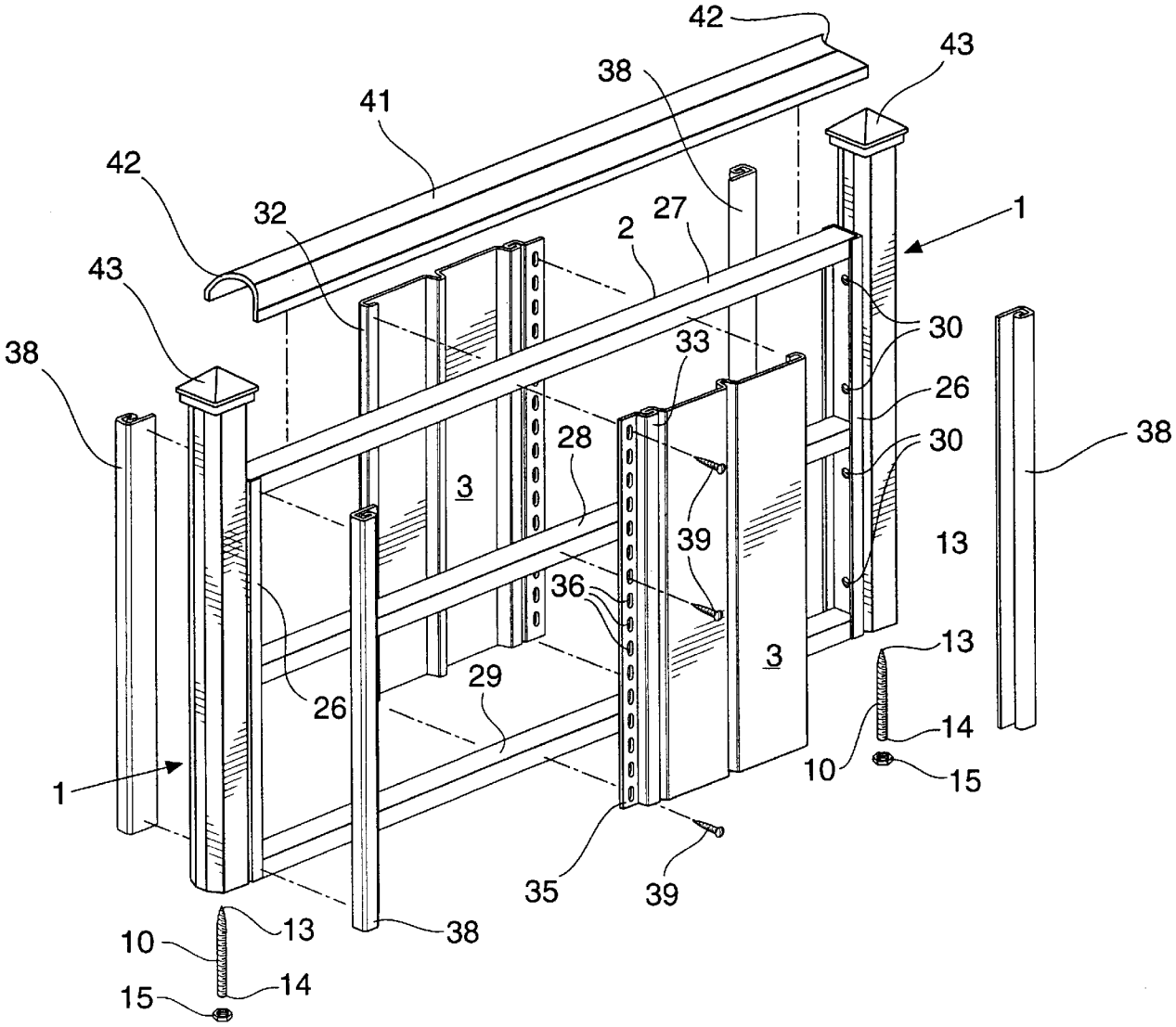
FIG. 2 is a partly exploded, isometric view of the basic elements of the fence system of FIG. 1.
Figure 3:
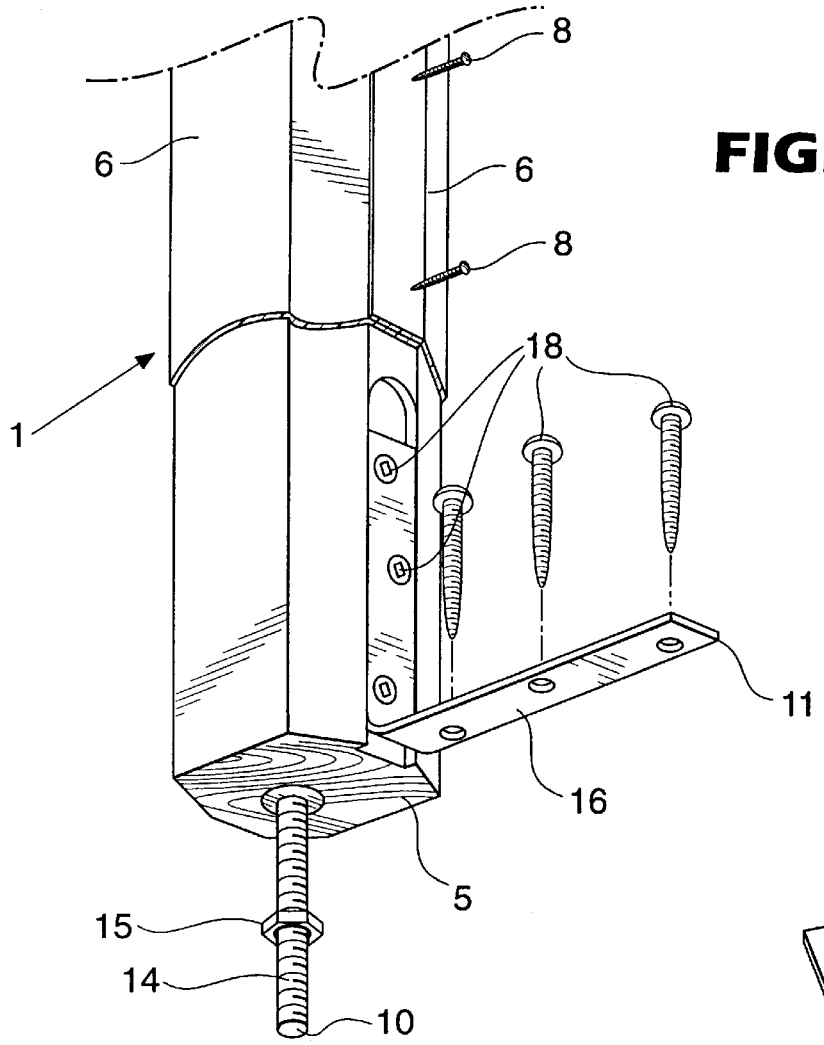
FIG. 3 is an isometric view of the bottom end of a post used in the fence system of FIG. 1.

Referring to FIGS. 1 and 2, the basic elements of the fence system include a plurality of spaced apart posts generally indicated at 1, frames 2 mounted on and interconnecting the posts 1, and panels 3 connected to each other and to the frames 2. As best shown in FIG. 3, each post 1 includes a wooden body 5 of octagonal cross section which is formed from a 4"×4" post by bevelling the corners of the post. The body 5 is covered by a cover defined by opposed sections 6 of vinyl (PVC). The vinyl sections 6 are formed of lengths of conventional eaves trough or rain gutter, the free edges of which are overlapped and glued together. The joint between the sections 6 can be strengthened using two or more screws 8, which also connect the cover sections 6 to the wooden body 5.

If the fence is being installed on a deck, e.g. as a privacy fence or around a swimming pool, a so-called hanger bolt 10, i.e. a bolt one-half of which is screw, and an L-shaped bracket 11 are provided on the bottom end of the post 1. The hanger bolt 10 is off-center, i.e. closer to the side of the post bottom opposite the side carrying the bracket 11. In effect, the bolt 10 anchors one side of the post 1, and the bracket 11 anchors the other side of the post. The hanger bolt 10 includes one tapered end 13 having a conventional screw thread for penetrating the bottom end of the body of the post. The other end of the hanger bolt is defined by a bolt 14 for receiving a nut 15. When the post 1 is mounted on a deck (not shown) the bolt 14 extends through the floor of the deck, and the horizontal arm 16 of the bracket 11 is connected to the top of the floor using screws 18. The vertical arm 19 of the bracket 11 is recessed in the bottom end of the post 1. For deck use, the inventor intends to provide the fence system in kit form, with the posts 1 completely assembled, i.e. including the body 5, the vinyl cover, the bolt 10 and the bracket 11. In such cases, it is merely necessary to mount the posts 1 on the deck, attach the frame 2 to the posts 1 and mount the panels on the frames.

When the fence system is being constructed on soft ground, the posts 1 are made three or four feet longer than the desired height of the fence. A hole is dug in the ground, the post 1 is placed in the hole and the earth is replaced around the post and packed down obviating the need for cement or another form of anchor.

Figure 4:
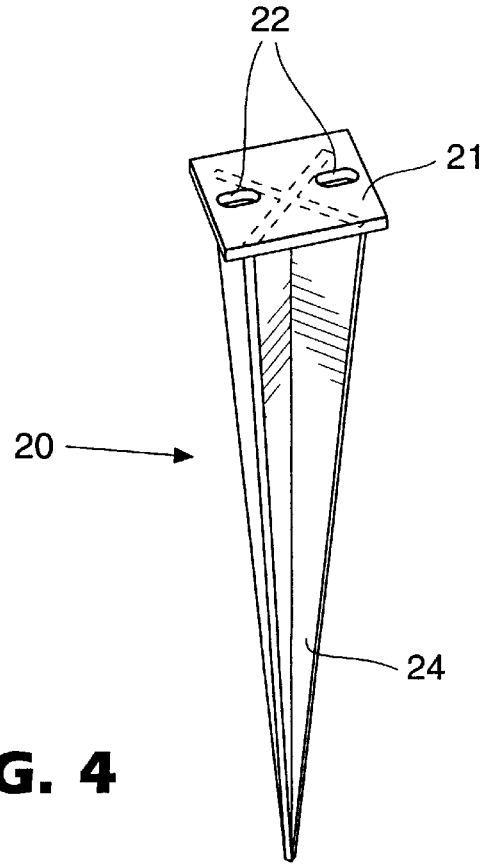
FIG. 4 is an isometric view of a post anchor used in the fence system of FIG. 1.

Alternatively, an anchor generally indicated at 20 in FIG. 4 is used to secure each post 1 in position. The anchor 20 includes a top plate 21 with slots 22 extending longitudinally thereof for receiving a pair of spaced apart bolts (not shown) extending downwardly from the bottom of each post 1. The slots 22 permit adjustment of the position of the post 1, i.e. it is not critical that the plates 21 be accurately spaced apart. A spike 24 with a cruciform cross section extends downwardly from the plate 21. Typically, the spike 24 is three fee long for ensuring firm anchoring of each post 1. When the ground is harder, cement footings or some other form of anchor can be used.

Figure 5:
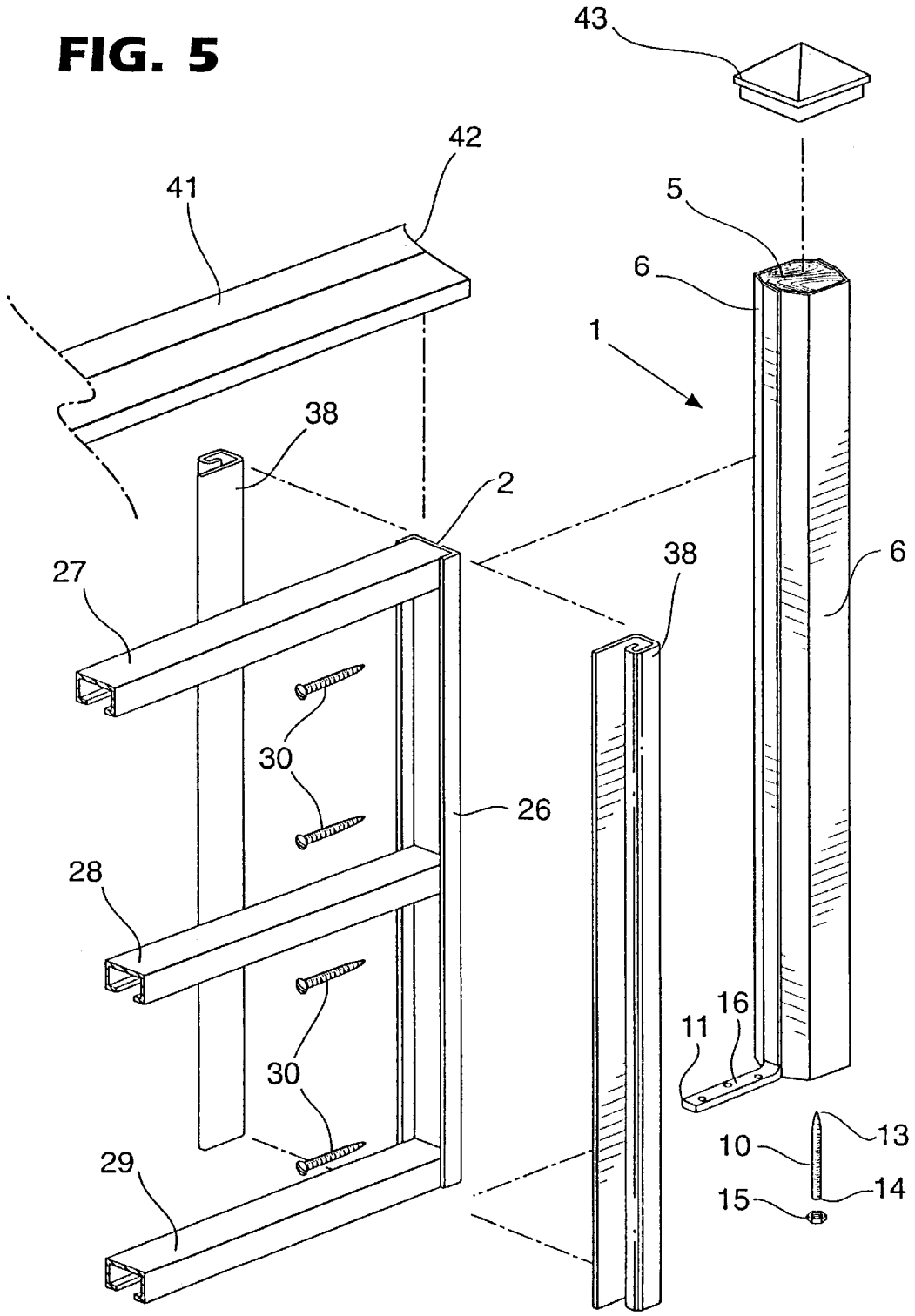
FIG. 5 is an exploded, isometric view of the one end of the fence system of FIG. 1 with parts omitted.

Referring to FIGS. 2 and 5, each frame 2 is formed using galvanized iron channel sections of the type which are normally used to rough in the interior walls of office buildings. The frame 2 includes ends 26 defined by so-called tracks of generally C-shaped cross section, and top, bottom and intermediate rails 27, 28 and 29, respectively extending between the ends 26. The rails 27, 28 and 29 are formed using conventional galvanized iron studs of generally C-shaped cross section. With the posts 1 firmly anchored in the ground or to a deck floor, the ends 26 are mounted on the posts 1 using screws 30, so that the ends 26 on successive posts 1 oppose each other, i.e. the open sides of the ends 26 face each other. The ends of the rails 27, 28 and 29 are inserted between the sides of the ends 26 and connected thereto using screws (not shown).

Figure 6:
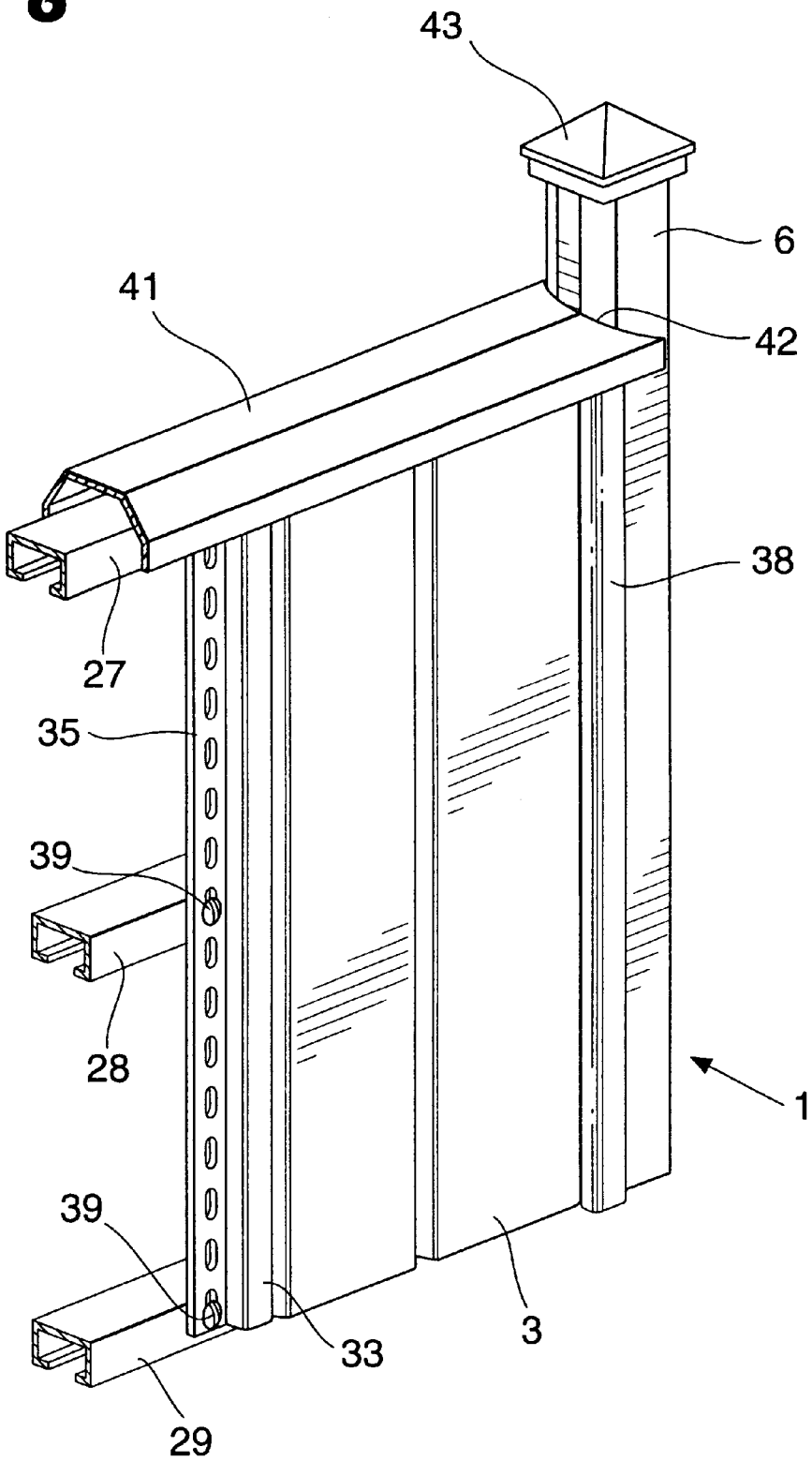
FIG. 6 is an isometric view of the end of the fence system of FIG. 5 in assembled condition.

Once the frame 2 has been completed, the panels 3 are mounted on the frame (FIGS. 2 and 6). The panels 3 are merely strips of vinyl siding of the type including a longitudinally extending hook 32 on one side for engaging a longitudinally extending groove 33 near the other side of the strip. A nailing strip 35 including a longitudinally extending row of holes or perforations 36 are provided on such other side for receiving nails or screws. In the present case, a conventional vinyl J-strip 38 is attached to the ends of the rails 27, 28 and 29. The hook side 32 of a strip of vinyl siding (panel 3) is slid into the J-strip 38, and screws 39 are used to connect the other side of the strip to the rails 27, 28 and 29. The nailing strip 35 is removed from the last panel 3 (on the left in FIGS. 1 and 2) of each section of fence, and the new side edge is tucked into the J-strip 38 on the second post 2. A couple of screws are used to secure the last panel 3 to the top and bottom rails 27 and 29, respectively. A cover 41 defined by an inverted length of vinyl eaves trough is pushed down over the top rail 27 and the exposed upper ends of the panels 3. The ends 42 of the cover sections are contoured to match the shape of the posts 1. The fence is completed by an off-the-shelf vinyl cap 43 on the each post 1.

I claim:

1. A fence system comprising:

at least two posts, a frame for mounting on said posts, said frame including a pair of C-cross section tracks for mounting on said posts in opposition to each other, and a plurality of C-cross section rails for extending between and into at least the top and bottom ends of said tracks;

a plurality of strips of vinyl siding on said rails, each said strip having a longitudinally extending hook on one side edge thereof and a longitudinally extending groove proximate a second side edge of the strip, said strips being mounted on said rails in side by side relationship with the hook on said one side edge of one strip mated with a groove on an adjacent strip, and a row of perforations in said second side edge for receiving screws to fasten the strip to said rails; and J-strips connected to each end of said frame abutting one of said posts for receiving the side edges of end strips.

2. A fence system of claim 1, wherein said post includes an elongated wooden body, and a sleeve defined by opposed, overlapping lengths of eaves trough.

3. The fence system of claim 2, including a cover for the top rail and the top ends of said strips of vinyl siding and said J-strips, said cover comprising a length of eaves trough.

4. The fence system of claim 1, including a ground anchor for each said post, said ground anchor including a top plate, bolts extending downwardly from each said post, slots in said top plate for receiving said bolts and an elongated spike extending downwardly from said top plate for penetrating the ground and anchoring the top plate and consequently the post.

5. The fence system of claim 1, including a deck anchor for anchoring each said post to a wooden deck, said deck anchor including an L-bracket on one side of the bottom end of each post, and a hanger bolt in the bottom end of said post near the other side thereof.

* * * * *